US012459778B2

(12) United States Patent
Huang

(10) Patent No.: US 12,459,778 B2
(45) Date of Patent: Nov. 4, 2025

(54) ADHESIVE TAPE ROLL

(71) Applicant: Yu-Chun Huang, Taichung (TW)

(72) Inventor: Yu-Chun Huang, Taichung (TW)

( * ) Notice: Subject to any disclaimer, the term of this patent is extended or adjusted under 35 U.S.C. 154(b) by 153 days.

(21) Appl. No.: 18/371,434

(22) Filed: Sep. 21, 2023

(65) Prior Publication Data

US 2025/0074740 A1 Mar. 6, 2025

(30) Foreign Application Priority Data

Sep. 5, 2023 (TW) ..... 112133703

(51) Int. Cl.
*B65H 75/24* (2006.01)

(52) U.S. Cl.
CPC ..... *B65H 75/24* (2013.01)

(58) Field of Classification Search
CPC ..... B65H 75/185
USPC ..... 242/611, 613.5
See application file for complete search history.

(56) References Cited

U.S. PATENT DOCUMENTS 2,693,918 A * 11/1954 Bretson ..... B65H 75/10 242/613.5
3,056,563 A * 10/1962 Whitnah ..... G11B 23/037 242/610.6
3,433,355 A * 3/1969 Smith ..... B65H 75/10 242/571
3,840,194 A * 10/1974 Vetter ..... B65H 75/185 242/613.5
4,385,734 A * 5/1983 Shiba ..... G11B 23/037 242/613.5
5,683,058 A * 11/1997 Schwarz ..... B65H 18/04 242/597.3
5,829,713 A * 11/1998 Kewin ..... B65H 75/30 242/613.5
2015/0210504 A1* 7/2015 Yu Chen ..... B65H 75/185 242/600

FOREIGN PATENT DOCUMENTS

EP 3 564 167 * 11/2019
KR 10-2071299 * 1/2020
KR 20-0490963 * 1/2020

* cited by examiner

*Primary Examiner* — William A. Rivera
(74) *Attorney, Agent, or Firm* — Bruce Stone LLP; Joseph A. Bruce

(57) ABSTRACT

A composite adhesive tape roll includes a rotating shaft member including a shaft tube, a shaft hole axially penetrating the shaft tube and a plurality of claws radially protruding outward from the shaft tube with the shaft tube as the center; and an attachment member including an annular outer loop and a plurality of clamping holes respectively corresponding to the shapes and positions of the claws and interconnected to form an accommodating space, so that the rotating shaft member can be placed in the accommodating space and the claws can correspondingly fall in the clamping holes respectively.

7 Claims, 7 Drawing Sheets

ADHESIVE TAPE ROLL

BACKGROUND OF THE INVENTION

1. Field of the Invention

The present invention relates to a device for using adhesive tape, in particular to a composite adhesive tape roll.

2. Description of the Related Art

When using an adhesive tape, the adhesive tape is generally installed on a rotating shaft, and then the rotating shaft is installed on the tape using equipment, such as a desktop tape dispenser, a handheld bag lid closer and other various adhesive tape using equipment. However, because commercially available adhesive tapes originally come in various sizes, the inner diameters of the shaft holes will also be different, which causes great trouble in the use of adhesive tapes. That is, in order to match the sizes of various tape rolls, the tape dispenser must have tape roll shafts of different sizes. Similarly, consumers also need to purchase different tape dispensers when using adhesive tape rolls of different sizes, which is a problem for consumers and manufacturers of tape dispensers.

SUMMARY OF THE INVENTION

The main object of the present invention to provide a composite adhesive tape roll that uses a simple structural combination so that the rotating shaft can be shared between two adhesive tape rolls of different sizes, especially for 3-inch and 3.5-inch adhesive tape rolls.

In order to achieve the above main object, the composite adhesive tape roll of the present invention comprises a rotating shaft member and an attachment member. The rotating shaft member comprises a shaft tube, a shaft hole axially penetrating the shaft tube, and a plurality of claws radially protruding outward from the shaft tube with the shaft tube as the center. The attachment member comprises an annular outer loop, and a plurality of clamping holes respectively corresponding to the shapes and positions of the claws of the rotating shaft member. The clamping holes are interconnected to form an accommodating space, so that the rotating shaft member can be placed in the accommodating space and each claw of the rotating shaft member can correspondingly fall in one respective clamping hole. With the above structures, the rotating shaft member of the composite adhesive tape roll of the present invention can be used to support a tape roll of one size, and the combination of the rotating shaft member and the attachment member can be used to support a tape roll of another size.

Preferably, each claw comprises two side walls, and the two side walls each have one end thereof connected to the shaft tube and an opposite end thereof forming a connecting section that is close to and connected to each other.

Preferably, each claw further comprises a protruding blocking block provided at the connection between the two side walls. The protruding blocking block protrudes in a direction away from the shaft tube.

DETAILED DESCRIPTION OF THE INVENTION

Figure 1:
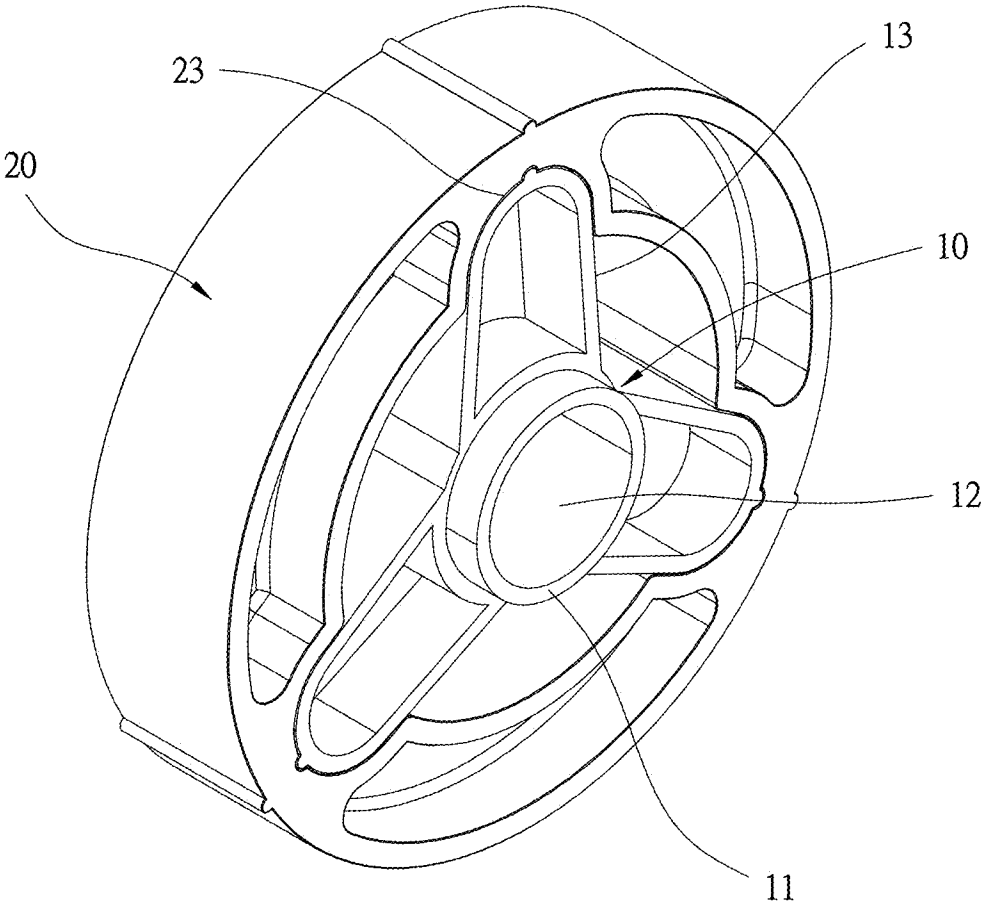
FIG. 1 is a three-dimensional schematic diagram of the present invention.
Figure 2:
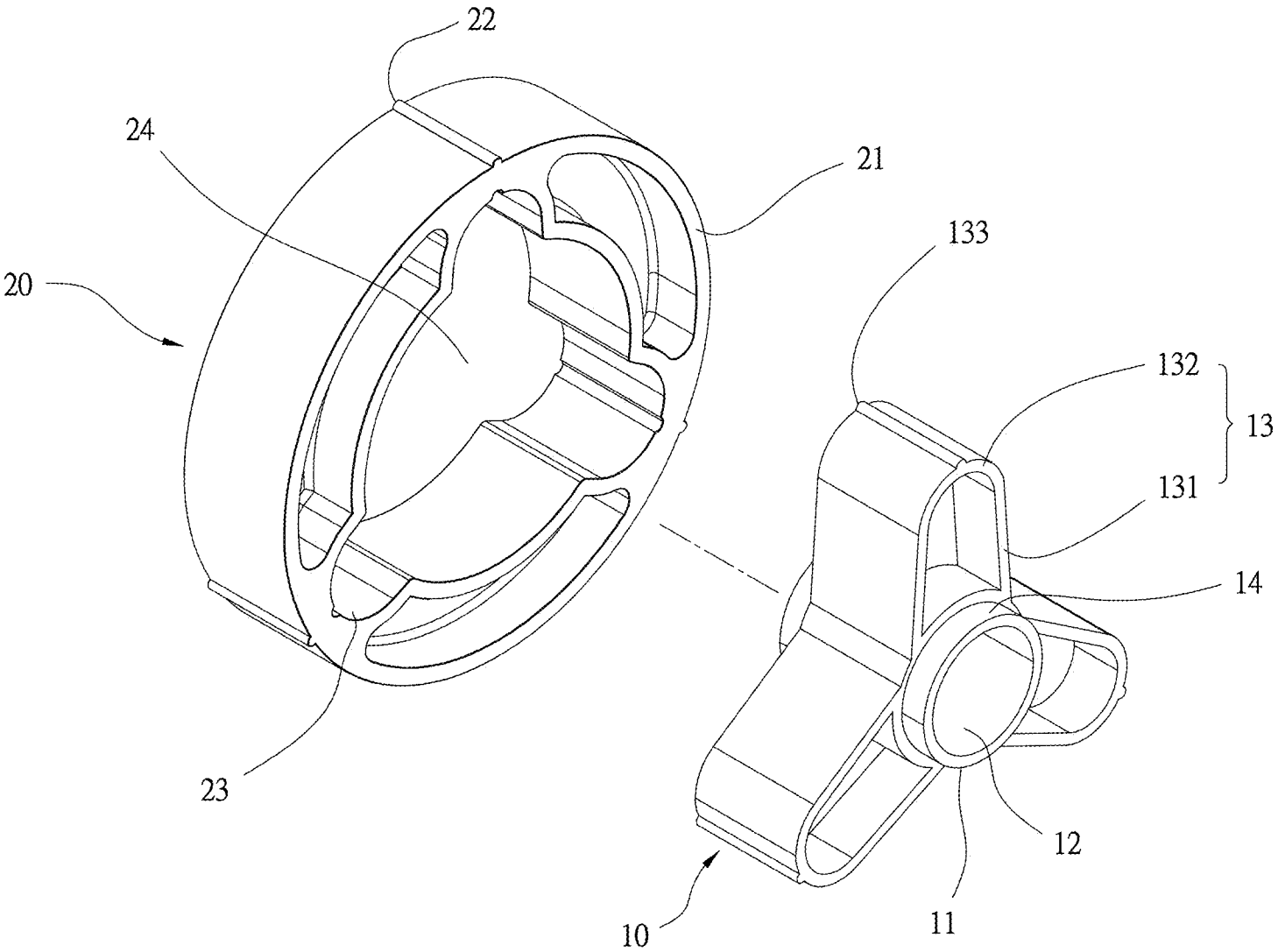
FIG. 2 is an exploded perspective view of the present invention.
Figure 3:
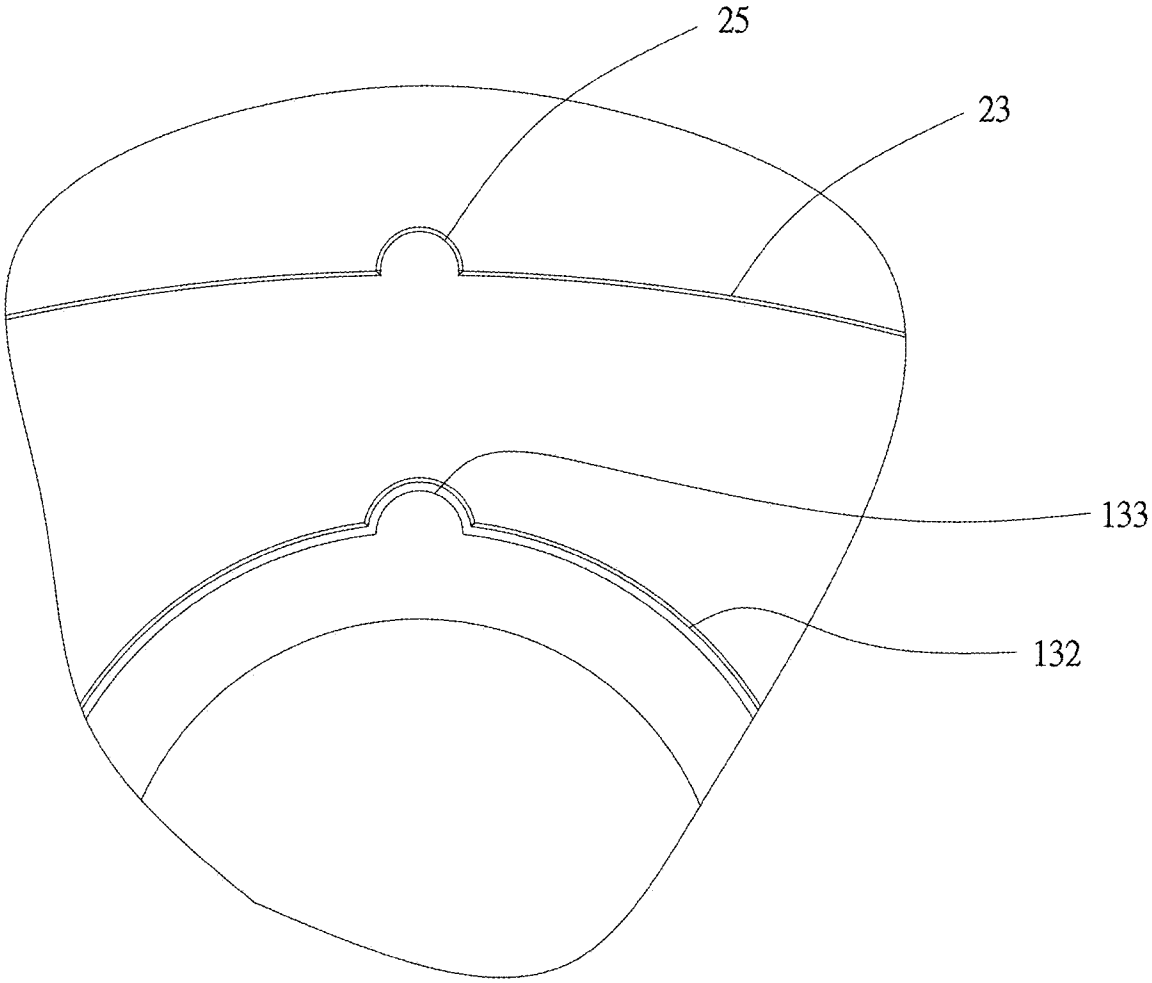
FIG. 3 is a partially enlarged schematic diagram of the present invention.

The applicant would like to first explain that in the entire description, including the embodiment introduced below and the claims in the patent application scope, terms related to directionality are based on the direction in the drawings. Secondly, in the preferred embodiment and drawings that will be introduced below, the same component numbers represent the same or similar components or their structural features. The directions indicated in the instruction are based on the directions of the drawings for ease of explanation and are not limited thereto.

As shown in FIGS. 1 to 4, the composite adhesive tape roll of the present invention comprises a rotating shaft member 10 and an attachment member 20.

Figure 4:
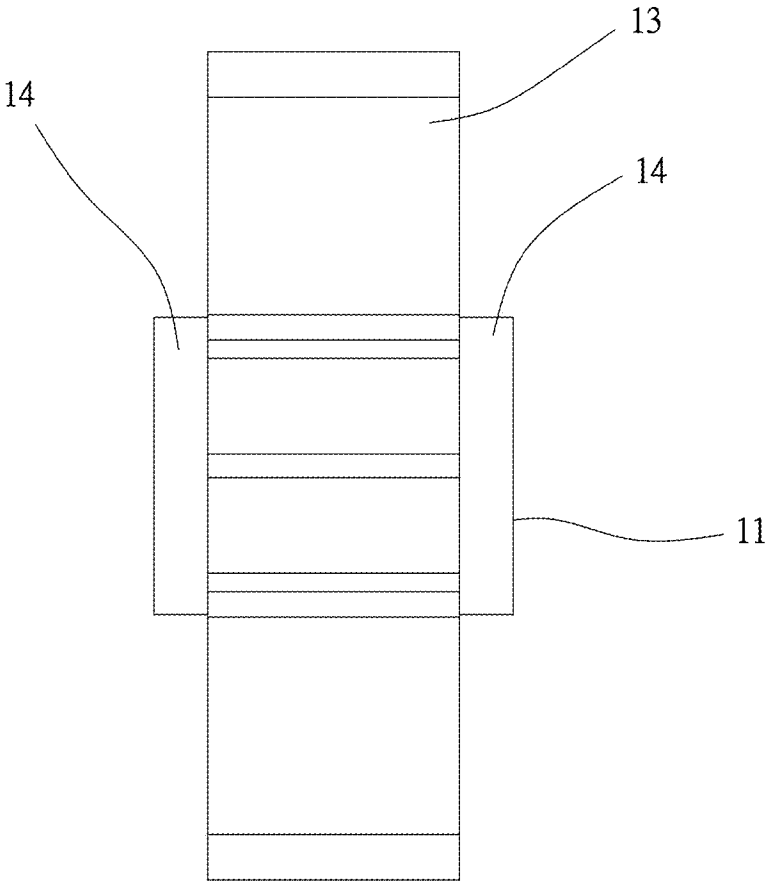
FIG. 4 is a top view of the rotating shaft member of the present invention.

The rotating shaft member 10 comprises a shaft tube 11 with a shaft hole 12 axially penetrating therethrough, and a plurality of claws 13 radially protruding outward from the shaft tube 11 with the shaft tube as the center. In this embodiment, three claws are used as an example, but it is not limited to this. Four, five, six, etc. claws can also be set. Each claw 13 comprises two side walls 131. One end of the two side walls is connected to the shaft tube 11 respectively, and the other end of the two side walls has an arc-shaped connecting section 132 that is close to and connected to each other. A protruding blocking block 133 is provided at the connection point. The protruding blocking block protrudes in a direction away from the shaft tube 11. The width of each claw 13 is smaller than the axial width of the shaft tube 11, so two wall portions 14 are formed between each claw 13 and the two ends of the shaft tube 11, as shown in FIG. 4.

The attachment member 20 comprises an annular outer loop 21. The outer surface of the annular outer loop is provided with a plurality of convex portions 22, and the convex direction of each convex portion 22 is radially arranged in a direction away from the center of the annular outer loop 21. The attachment member 20 is provided with a plurality of clamping holes 23, and the clamping holes 23 respectively correspond to the shapes and positions of the claws 13 on the rotating shaft member. The clamping holes 23 are interconnected to form an accommodating space 24, so that the rotating shaft member 10 can be placed in the accommodating space 24 and each claw 13 of the rotating shaft member can correspondingly fall in each clamping hole 23. In this embodiment, the clamping holes 23 of the attachment member correspond to the arc-shaped connecting sections 132 of the claws, and a dimple 25 is recessed on one side of each clamping hole 23 and used to accommodate the protruding blocking block 133 of the respective claw.

Figure 7:
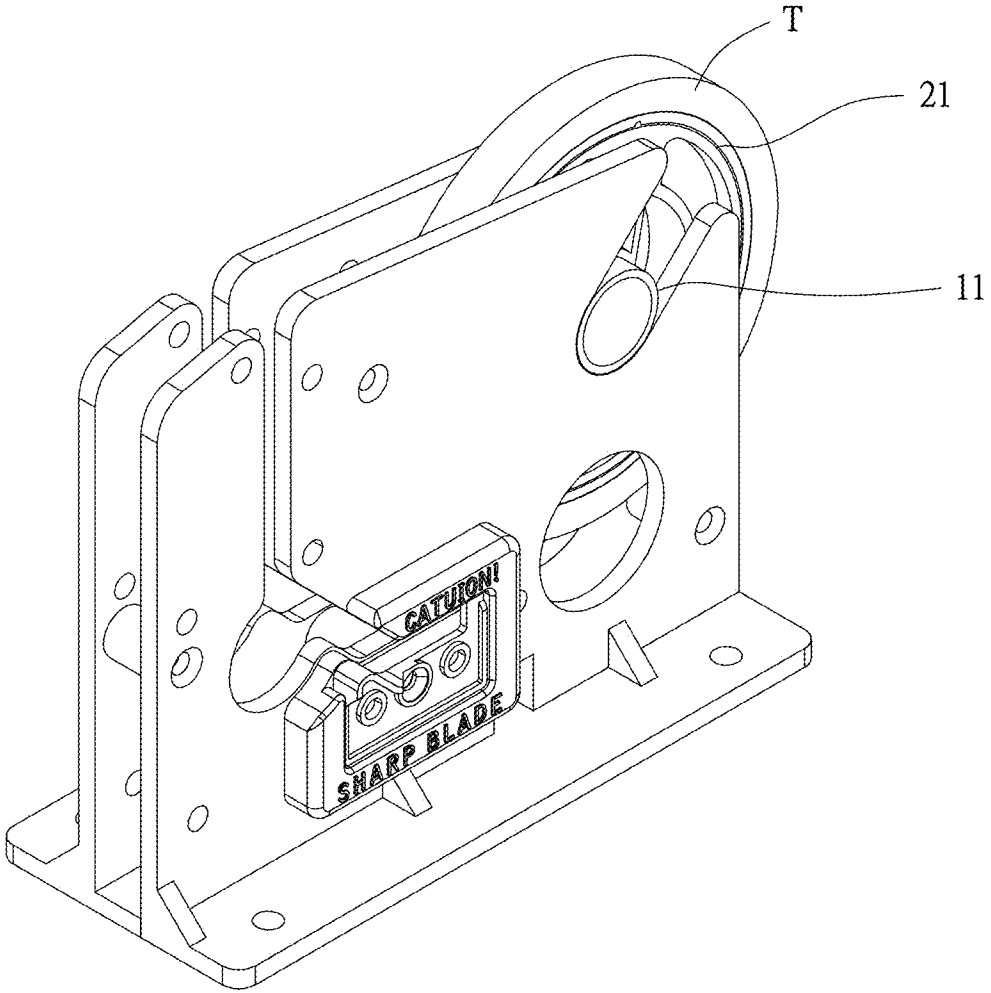
FIG. 7 is a schematic diagram of the present invention when used in a bag neck sealer.

According to the structure described above, the composite adhesive tape roll of the present invention can be installed on various tape using equipment, such as a desktop tape dispenser, a handheld ape dispenser, bag lid closer and other various adhesive tape using equipment. When setting, you can use the shaft hole of the rotating shaft member to set or the shaft tube of the rotating shaft member to set. As shown in FIG. 7, it is an example of using the wall portions 14 between the shaft tube and the claws to set the composite adhesive tape roll on a bag neck sealer.

Figure 5:
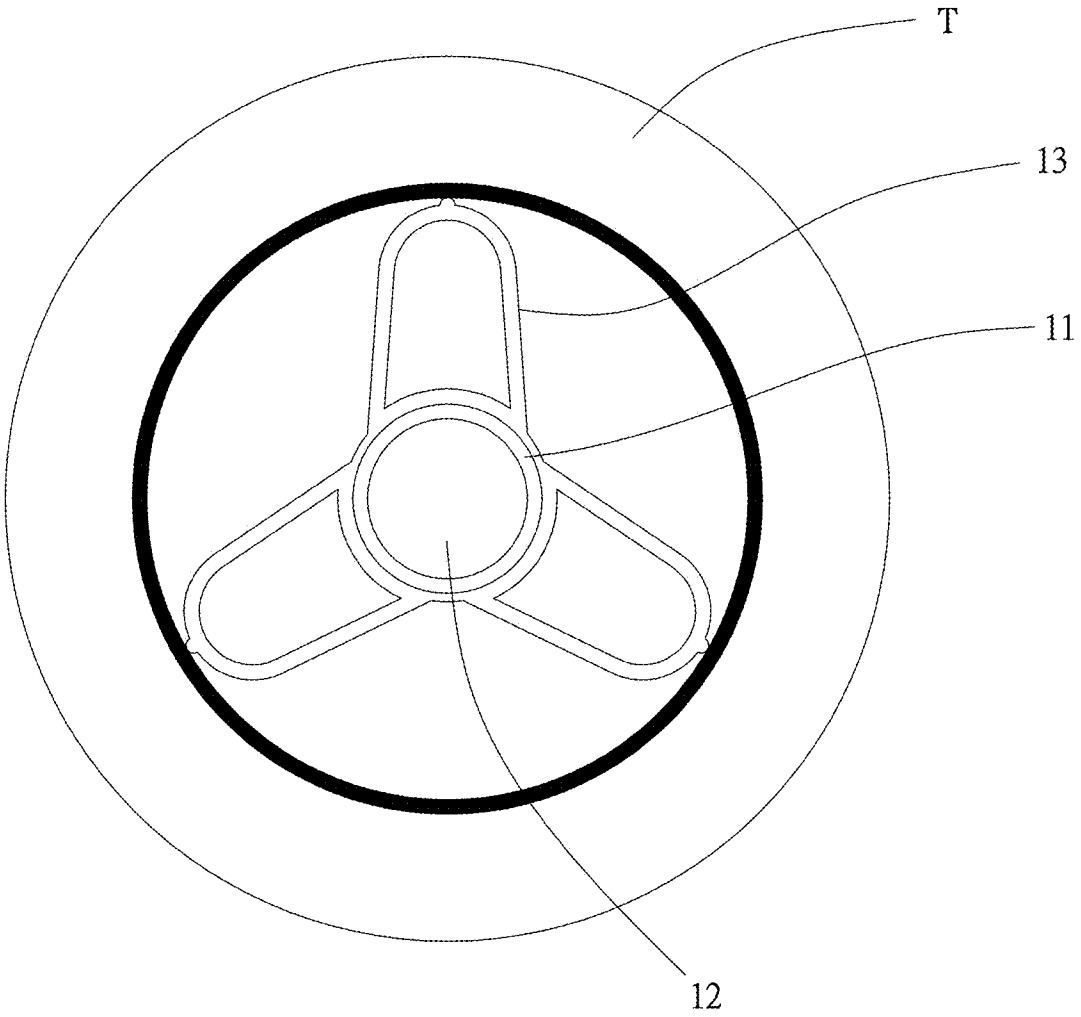
FIG. 5 is a schematic diagram of the rotating shaft member in use according to the present invention.

The maximum outer diameter of the rotating shaft member 10 is consistent with the inner diameter of a 3-inch adhesive tape roll T. Therefore, if you want to use a 3-inch adhesive tape roll, you only need to use the rotating shaft member 10 alone. When the rotating shaft member 10 is installed in the adhesive tape roll, the protruding blocking blocks 133 can bear against the inner wall of the adhesive tape roll T, as shown in FIG. 5.

Figure 6:
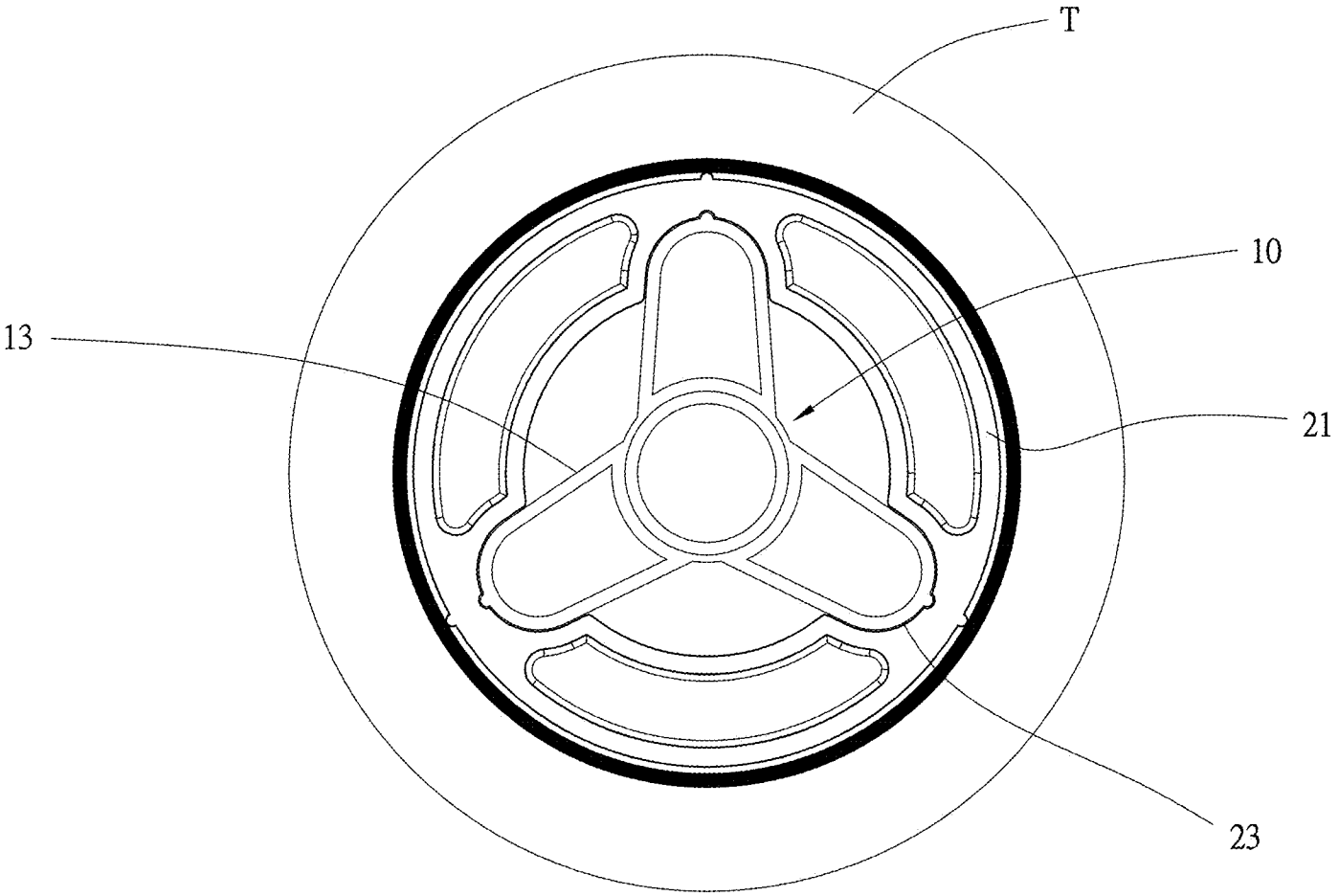
FIG. 6 is a schematic diagram of the attachment member in use according to the present invention.

When the tape size to be used is a 3.5-inch adhesive tape, the user can insert the rotating shaft member 10 into the attachment member 20 so that the claws 13 correspond to the clamping holes 23 of the attachment member, so that the rotating shaft member 10 can be combined with the attachment member 20. The adhesive tape roll T is placed outside the annular outer loop 21 of the attachment member, so that the convex portions 22 of the annular outer loop can be pressed against the inner wall of the adhesive tape roll T, and the shaft tube 11 of the rotating shaft member can be used as a rotating shaft and can be installed on the tape using equipment, as shown in FIG. 6. In this way, the purpose of using the same tape using equipment for two different sizes of adhesive tapes can be achieved.

What is claimed is:

1. A composite adhesive tape roll, comprising:

a rotating shaft member comprising a shaft tube, a shaft hole axially penetrating said shaft tube, and a plurality of claws radially protruding outward from said shaft tube with said shaft tube as the center, wherein each said claw comprises two side walls, said two side walls each having one end thereof connected to said shaft tube and an opposite end thereof forming a connecting section that is close to and connected to each other and each said claw further comprises a protruding blocking block provided at the connection between the two said side walls, said protruding blocking block protruding in a direction away from said shaft tube; and an attachment member comprising an annular outer loop and a plurality of clamping holes respectively corresponding to the shapes and positions of said claws of said rotating shaft member, said clamping holes being interconnected to form an accommodating space, so that said rotating shaft member is capable of being placed in said accommodating space to let each said claw correspondingly fall in one respective said clamping hole.

2. The composite adhesive tape roll of claim 1, wherein said clamping holes of said attachment member correspond to said arc-shaped connecting sections of said claws, and a dimple is recessed on one side of each said clamping hole and used to accommodate said protruding blocking block of one respective said claw.

3. The composite adhesive tape roll of claim 2, wherein the width of each said claw is smaller than the axial width of said shaft tube, so that two wall portions are formed between each said claw and two opposite ends of said shaft tube.

4. The composite adhesive tape roll of claim 3, wherein said connecting section of each of said two side walls of each said claw is arc-shaped.

5. The composite adhesive tape roll of claim 4, wherein said attachment member further comprises a plurality of convex portions located on an outer surface of said annular outer loop, and the convex direction of each said convex portion is radially arranged in a direction away from the center of said annular outer loop.

6. The composite adhesive tape roll of claim 1, wherein said clamping holes of said attachment member correspond to said arc-shaped connecting sections of said claws, and a dimple is recessed on one side of each said clamping hole and used to accommodate said protruding blocking block of one respective said claw.

7. The composite adhesive tape roll of claim 1, wherein said attachment member further comprises a plurality of convex portions located on an outer surface of said annular outer loop, and the convex direction of each said convex portion is radially arranged in a direction away from the center of said annular outer loop.

* * * * *